United States Patent [19]

Tufts

[11] 3,983,548

[45] Sept. 28, 1976

[54] FIRE DETECTION SYSTEM

[76] Inventor: Howard L. Tufts, 9 Fisher Road, Hingham, Mass. 02043

[22] Filed: Feb. 19, 1975

[21] Appl. No.: 550,932

[52] U.S. Cl. ..... 340/228 R; 340/409

[51] Int. Cl.[2] ..... G08B 17/06

[58] Field of Search ..... 340/410, 214, 228 R, 340/411, 409

[56] References Cited

UNITED STATES PATENTS

| | | | |
|---|---|---|---|
| 3,188,593 | 6/1965 | Vasel et al. | 340/228 R |
| 3,268,881 | 8/1966 | Vasel | 340/228 R |
| 3,550,120 | 12/1970 | Kompelien | 340/228 R |
| 3,588,892 | 6/1971 | Scheidweiler | 340/410 |
| 3,678,510 | 7/1972 | Walthard et al. | 340/410 |

*Primary Examiner*—Glen R. Swann, III

[57] ABSTRACT

A fire detection system of the type utilizing an optical detector with discriminating photo-cells connected in series to form a voltage divider, with the rise in voltage at the junction of the photo-cells being utilized at the input to an amplifier to energize an alarm or activate an extinguishing system, in which a remotely controlled switch is provided for applying to the signal lead at the detector a test voltage from the remote end of the power lead at the detector, whereby both the continuity of the power lead, the continuity of the signal lead and the operativeness of the power supply are tested.

8 Claims, 3 Drawing Figures

F2
Bc
14
F1
Rc 16
18
Bc
T
F2
3
F1
3
Rc
14

STb
STa
ST
+
ALARM ACTUATING MEANS
A
+
−
12
PT
P
S2
Sb
Sa
G
Rc
J
Bc
T
D
10
R1
X
R2
10a
10b

FIRE DETECTION SYSTEM

BACKGROUND OF THE INVENTION

Certain types of fire detecting apparatus utilize an optical detector comprising a pair of photo-cells connected in series across a voltage source. The cells are responsive to different wave lengths of light, so that on receiving sunlight or incandescent light, both cells respond by a drop in resistance, so that the voltage at the junction between the cells changes only slightly. However, when exposed to light with substantially only infra-red or red components, the resistance of one cell drops substantially and the resistance of the other cell drops little, if at all. Hence, assuming that the positive pole of the power source is connected to the red-responsive cell, the voltage at the junction rises appreciably, and the rise in voltage is used as the input to the amplifier to activate an alarm. A detector of this type is shown in U.S. Pat. No. 3,188,593 issued June 8, 1965.

One problem associated with detector systems of this type is the testing of the operability of the detector system. In the case of aircraft installations, such testing should be done in preparing the aircraft for flight. Although during overhaul procedures, the fire detection system may be tested by shining a red light on the detector cells, such a procedure is obviously impractical for a daily pre-flight check, and it is therefore necessary that some simple, rapid test procedure be available in the cockpit, so that the fire detector system can be tested by the pilot before each take-off, or, if desired, in flight.

SUMMARY OF THE INVENTION

In an optical detector of the type described, each detector, which comprises a photo-cell responsive to red or infra-red radiation and a cell responsive to radiation in the blue-green band connected in series through a signal lead junction, also comprises a switching device, such as a transistor connected so as to provide a current path in parallel with the red-responsive cell. In a particular embodiment of the invention, the collector-emitter path of a transistor is connected in parallel with the red-responsive cell so that when a voltage is applied to the base, conduction occurs through the collector-emmiter path, which applies a test voltage from the power lead to the signal lead thus testing the continuity of the power lead to the detector, the signal lead from the detector, and the operativeness of the power source.

DESCRIPTION OF A PREFERRED EMBODIMENT

Figure 3:
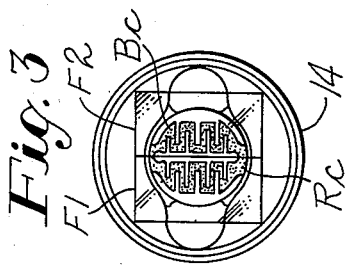
FIG. 3 is a view in section taken on line 3-3 of FIG. 2.
Figure 2:
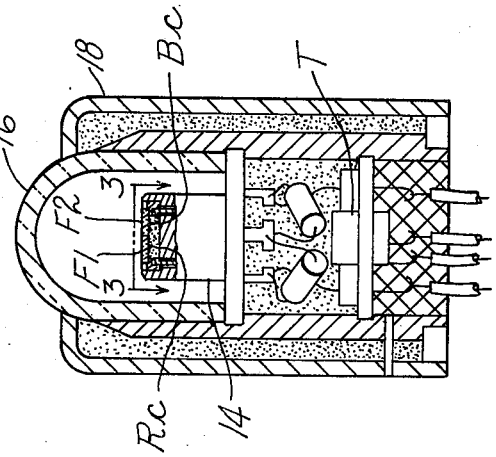
FIG. 2 is a view in side elevation partly broken away, of a detector for use with the system of FIG. 1.
Figure 1:
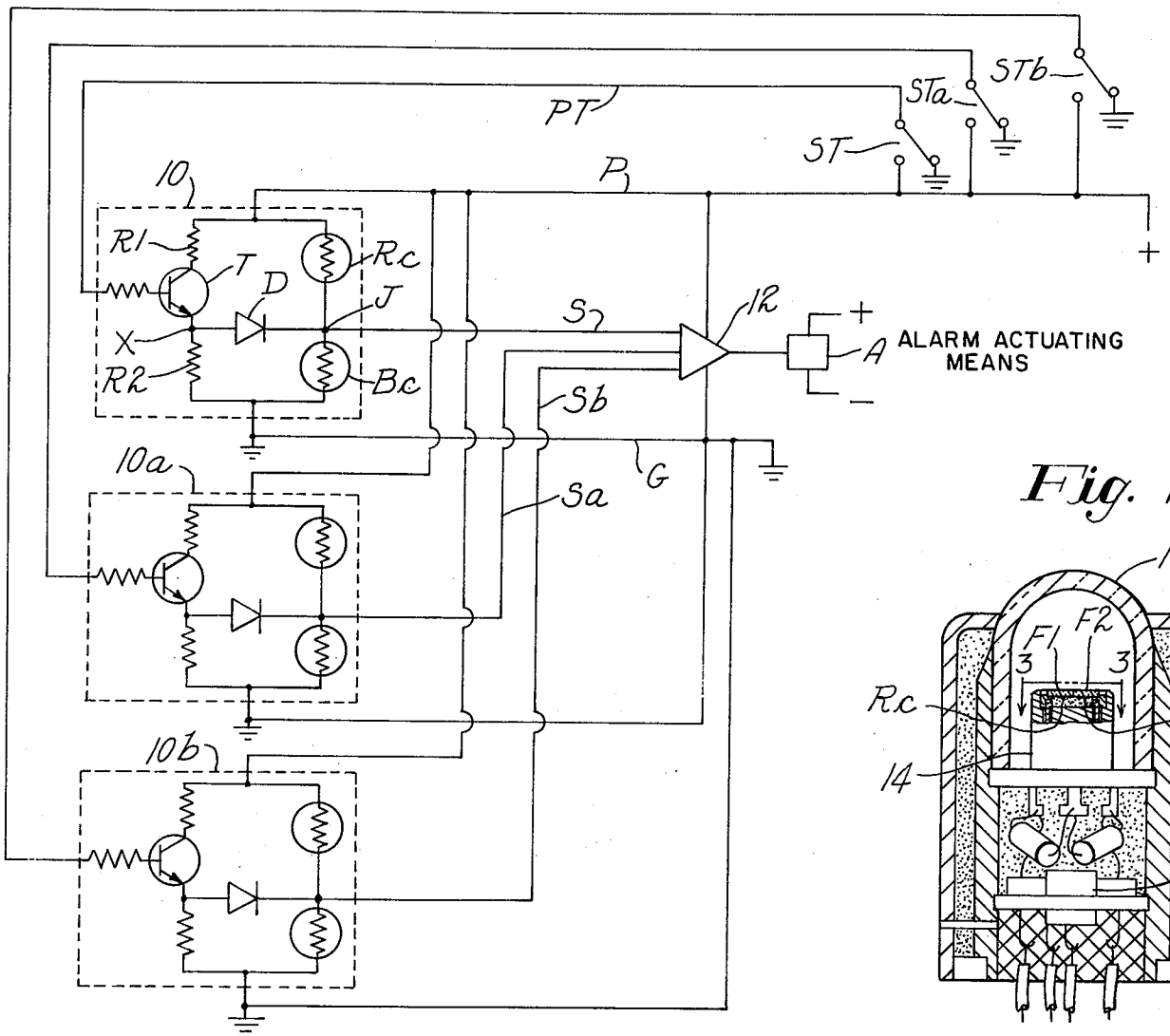
FIG. 1 is a schematic diagram of a flame detector system embodying the features of the invention.

Referring to FIG. 1 of the drawing, there is illustrated a detector system comprising a series of detector units 10, an amplifier 12, and an alarm actuating device A.

In the usual installation in an aircraft, the power supply, amplifier, alarm (which may be a buzzer or a red light) and test switches are located on a control panel in the cockpit and the detectors are disposed in various remote locations in the aircraft, such as in engine housings and baggage compartments.

The detectors each comprise a pair of photo-resistive cells RC and BC connected in series through a signal lead junction J between the power lead P and the ground lead G.

The photo-cell RC is primarily responsive (by a drop in resistance) to light in the red to infra-red band, and the photo-cell BC is primarily responsive to light in the blue-green band. The cells may be provided with the desired response by the use of suitable filters and if desired, the cells RC and BC may be portions of a single photo-resistive device, with suitable filters F1 and F2 disposed over each portion to produce the desired response in the manner shown in U.S. Pat. No. 3,188,593 issued June 8, 1965 to Alfred W. Vasel et al and assigned to the same assignee as the present application.

The junction J is connected by signal lead S to an imput of amplifier 12.

In operation, when the detector 10 is exposed to normal ambient light, which contains both red and blue-green components both photo-cells drop in resistance so that the voltage at the junction J, in the case of sunlight, does not exceed about 15% of the supply voltage and in the case of incandescent light about 35% of supply voltage. However, when exposed to radiation from a fire, which contains mostly red to infra-red radiation and very little blue-green radiation, the resistance of cell RC drops substantially; however the resistance of cell BC drops only slightly, so that the voltage at the junction rises to 50% of supply voltage or more, depending on the intensity of the fire.

The amplifier 12 may be set to provide an output to the alarm actuating device A when the voltage at junction J reaches 50% of supply voltage.

The amplifier may be provided with a pluarality of inputs, to accomodate a plurality of detector units, 10*a*, 10*b*, etc.

Portion of the system described above has been in commercial use in many types of aircraft for a number of years. Testing of the system has been accomplished only on periodic aircraft overhauls, by shining a red light onto each detector unit to see if the alarm is activated.

However, it has been considered desirable to provide means to enable the pilot to test the fire detector system from the cockpit before flight.

For this purpose each detector unit 10 in the illustrated embodiment of the invention comprises a transistor T, with the collector-emitter path thereof being connected in series with a current limiting resistor R1, said collector-emitter path and said resistor being connected from the power lead P through a junction X in series with a second resistor R2 connected to ground. The junction X is connected to the junction J by a diode D so that voltage appearing at junction J due to fire radiation cannot pass to ground through resistor R2, but voltage appearing at junction X will be applied to junction J and the signal lead S.

To test the detections, a two-pole switch ST may be provided at the cockpit control panel for each detector. The base of transistor T is connected to the common terminal of switch ST by lead PT, one pole of switch ST is connected to ground and the other pole is connected to the positive terminal of the power supply. The switch ST may be biased to the position shown, grounding the base of transistor T so that no conduction occurs in the collector-emitter path thereof, and the junction X is substantially at ground voltage.

When the switch ST is actuated to connect the base of transitor T to the power supply through lead PT, conduction occurs in the collector-emitter path thereof from the power lead P through resistors R1 and R2 to ground. A voltage therefore appears at junction X. The circuit parameters are such that the voltage appearing at junction X, and consequently on the signal lead S, is over 50% of supply voltage so that the alarm is activated.

In a physical embodiment of the detector unit of the invention, the photo-cells RC and BC with their associated filters are mounted on a support block 14, covered by a translucent dome 16, and retained in a metallic housing 18, as illustrated in the above-mentioned U.S. Pat. No. 3,188,593. The rear portion of the housing contains the transistor T, diode D and resistors R1 and R2 suitably potted in insulating material with leads S, G, P and PT extending from the rear of the housing.

A failure to produce an alarm signal from a particular detector indicates that there is a break in either the power lead or the signal lead, or a failure of the power source. A failure to produce an alarm signal from all detectors indicates a failure of the power source, or of the amplifier.

Although the system described herein will not indicate an open ground connection, since a return path for the transistor T exists through the signal lead into the amplifier 12, a special circuit to test for ground continuity is not required for two reasons. First, the ground end of the cell BC is grounded to the metallic housing 18, which is mounted on and in electrical contact with the frame of the aircraft, to which the entire electrical system is grounded. This ground, in addition to the ground provided by the lead G from the detector to the control panel, makes it very unlikely that there would not be a ground path to the detector 10. Second, unless the detector 10 is in total darkness, an open ground will cause the voltage at junction J to rise to substantially full line voltage, and cause a false alarm. If desired, the circuitry shown and claimed in U.S. Pat. No. 3,268,881 may be utilized in the amplifier 10 to prevent a false alarm from an open ground.

Although in the illustrated embodiment of the invention, individual switches are shown for testing each detector, it will be understood that a single muliple-pole rotary switch may be provided to sequentially disconnect the base of each transistor T from ground and apply the test voltage thereto. It will also be understood that in some installations a number of detectors may be connected in parallel to each signal lead. In such case, only the detector at the extreme end of this signal lead would be required to have the test transistor incorporated therein.

Although the invention has been described as used in an aircraft fire detection system, it will be understood that the principle of the herein disclosed test circuit may be used in other types of devices where it is desired to test the continuity of a circuit to a remote location.

Since certain other obvious changes may be made in the illustrated embodiment of the invention without departing from the scope thereof, it is intended that all matter contained herein be interpreted in an illustrative and not a limiting sense.

I claim:

1. A detector system, comprising alarm actuating means and a detector element remote therefrom and connected thereto by a power lead, a signal lead and a ground path, and means for testing the continuity of the power lead and the signal lead, said means comprising first switching means at the detector which, when activated, completes a circuit between the power lead and the signal lead to apply a voltage from the power lead to the signal lead great enough to activate the alarm actuating means and second switching means remote from the first switching means for activating said first switching means at the detector.

2. A detector system as set out in claim 1 in which said first switching means is a transistor having a base, emitter and collector and having its collector-emitter path connected between the power lead and the signal lead, the base of said transistor being connected to said second switching means, the operation of said second switching means applying a bias voltage to the base of the transistor as to cause conduction in the collector-emitter path thereof so as to apply a voltage to said signal lead to activate the alarm actuating means.

3. A detector system as set out in claim 2 in which said second switching means connects the base of said transistor to ground and is operable to connect the base of said transistor to a bias voltage such that conduction occurs in the collector-emitter path thereof to apply sufficient voltage to the signal lead to activate the alarm actuating means.

4. In a detector system, comprising alarm actuating means and a detector remote therefrom and connected thereto by a power lead, a signal lead, and a ground path, said detector comprising a pair of impedance elements connected in series through a junction between the power lead and the ground, the junction being connected to the signal lead, at least one of said impedance elements being variable in response to a condition to be detected so as to increase the voltage on said signal lead to a value high enough to activate the alarm actuating means, the improvement comprising first switching means at the detector for completing a circuit between the power lead and the signal lead, whereby when said first switching means is activated a voltage is applied from the power lead to the signal lead of sufficient value to activate the alarm actuating means and second switching means to activate said first switching means.

5. A detector system as set out in claim 4 in which said first switching means at the detector comprises a transistor having a base, emitter, and collector and having its collector-emitter path connected to provide a circuit path between the power lead and signal lead, the base of said transistor being connected to said second switching means, said second switching means normally connecting said base to ground and being operable to apply a bias voltage to the base to cause conduction in the collector-emitter path to cause a voltage to appear on the signal lead to activate the alarm actuating means.

6. A detector for use in a fire detector system comprising a pair of photo-resistive elements connected in series through a signal lead connection between a power connection and a ground connection, one of said photo-resistive elements being variable in response to a condition to be detected whereby the voltage at the signal lead connection increases in response to the occurrence of the condition, and switching means to make and break a circuit between the power connection and the signal lead connection, whereby when said detector is connected into a detector system, the activation of said switching means will cause a voltage to be applied from the power connection to the signal lead connection.

7. A detector as set out in claim 6 in which said switching means is controllable by a voltage applied thereto.

8. A detector as set out in claim 6 in which said switching means to make and break a circuit between the power connection and the signal lead connection comprises a transistor having a collector connected to the power connection, an emitter connected to a junction, and a base, said junction being connected to the ground connection through a resistor and to the signal lead connection through a diode poled to allow current to flow from the junction to the signal lead connection, the conduction in the collector-emitter path causing a voltage to appear at the signal connection, said conduction being controlled by voltage applied to the base of said transistor.

* * * * *